US010519902B2

(12) United States Patent
Fukui et al.

(10) Patent No.: US 10,519,902 B2
(45) Date of Patent: Dec. 31, 2019

(54) INTAKE MANIFOLD

(71) Applicant: TOYOTA JIDOSHA KABUSHIKI KAISHA, Toyota-shi, Aichi-ken (JP)

(72) Inventors: Masato Fukui, Toyota (JP); Kazuki Ota, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/105,728

(22) Filed: Aug. 20, 2018

(65) Prior Publication Data

US 2019/0093609 A1 Mar. 28, 2019

(30) Foreign Application Priority Data

Sep. 25, 2017 (JP) ..... 2017-183612

(51) Int. Cl.

| | |
|---|---|
| ***F02M 35/10*** | (2006.01) |
| ***F02M 35/116*** | (2006.01) |
| ***F02B 75/22*** | (2006.01) |
| *F02B 75/18* | (2006.01) |

(52) U.S. Cl.

CPC ..... *F02M 35/10314* (2013.01); *F02B 75/22* (2013.01); *F02M 35/116* (2013.01); *F02B 2075/1808* (2013.01)

(58) Field of Classification Search

CPC . F02M 35/10314; F02M 35/116; F02B 75/22; F02B 2075/1808

See application file for complete search history.

(56) References Cited

U.S. PATENT DOCUMENTS

| | | | | | |
|---|---|---|---|---|---|
| 3,667,432 | A * | 6/1972 | Greathouse | F02B 77/11 | 123/184.38 |
| 3,827,416 | A * | 8/1974 | Ader | F02M 31/087 | 123/547 |
| 4,440,120 | A * | 4/1984 | Butler | F02B 75/22 | 123/184.34 |
| 4,649,871 | A * | 3/1987 | Hatamura | F02B 27/00 | 123/184.35 |
| 4,889,083 | A * | 12/1989 | Honma | F02B 75/22 | 123/184.34 |

(Continued)

FOREIGN PATENT DOCUMENTS

| | | | | |
|---|---|---|---|---|
| EP | 0251180 A2 * | 1/1988 | ..... | F02B 75/22 |
| JP | H02-241965 A | 9/1990 | | |

(Continued)

*Primary Examiner* — Hung Q Nguyen
(74) *Attorney, Agent, or Firm* — Oliff PLC

(57) ABSTRACT

A first downstream part of an intake manifold has a first downstream passage configured to communicate with an intake port of a first cylinder head. A second downstream part of the intake manifold has a second downstream passage configured to communicate with an intake port of a second cylinder head. An upstream part is coupled to the first downstream part and the second downstream part. The upstream part is arranged upstream from the first and second downstream parts in the flow direction of intake air and has a first upstream passage and a second upstream passage. The material of the first downstream part and the material of the second downstream part both have higher rigidity than the material of the upstream part.

4 Claims, 2 Drawing Sheets

(56) References Cited

U.S. PATENT DOCUMENTS 4,901,681 A * 2/1990 Pozniak ..... F02B 75/22 123/184.31
4,919,087 A * 4/1990 Ogami ..... F02B 27/02 123/184.36
4,925,510 A * 5/1990 Hojo ..... F02M 35/10321 156/153
5,003,932 A * 4/1991 Duncan ..... F02B 27/00 123/184.34
5,012,771 A * 5/1991 Oda ..... F02B 27/02 123/184.38
5,127,370 A * 7/1992 Suzuki ..... F02B 27/00 123/184.35
5,322,038 A * 6/1994 Urabe ..... F02B 27/02 123/184.31
5,341,781 A * 8/1994 Gerhardt ..... F01L 1/185 123/195 R
5,544,629 A * 8/1996 Ohata ..... F02B 75/22 123/184.36
5,823,156 A * 10/1998 Thiel ..... F02M 35/10052 123/184.31
5,970,939 A * 10/1999 Motosugi ..... F02M 35/10144 123/184.21
5,992,370 A * 11/1999 Pringle ..... F02B 27/02 123/184.55
6,142,114 A * 11/2000 Yoshikawa ..... F02M 35/10072 123/184.42
6,192,848 B1 * 2/2001 Hada ..... F02M 35/10131 123/184.24
6,213,074 B1 * 4/2001 Freese ..... F02B 75/22 123/195 C
6,622,682 B2 * 9/2003 Ikuma ..... F02M 35/10039 123/184.34
7,370,620 B1 * 5/2008 Nino ..... F02M 35/10039 123/184.32
10,240,564 B2 * 3/2019 Nakamura ..... F02M 35/116
2002/0148427 A1 * 10/2002 Jones ..... B29C 66/1142 123/184.61
2003/0037757 A1 * 2/2003 Osband ..... F02B 75/22 123/195 R
2003/0079707 A1 * 5/2003 Brassell ..... F02M 35/10045 123/184.61
2003/0140897 A1 * 7/2003 Zehnal ..... F02M 35/10085 123/456
2006/0027203 A1 * 2/2006 Cunningham ... F02M 35/10144 123/184.47
2006/0207527 A1 * 9/2006 Saeki ..... F02B 23/104 123/54.4
2007/0039571 A1 * 2/2007 Redon ..... F01M 5/002 123/41.31
2008/0149060 A1 * 6/2008 Wilson ..... F02M 35/10196 123/184.47
2009/0293831 A1 * 12/2009 Harada ..... F02M 35/10085 123/184.53
2011/0214640 A1 * 9/2011 Chang ..... F02B 31/00 123/306
2016/0230510 A1 * 8/2016 Micken ..... F04B 53/16

FOREIGN PATENT DOCUMENTS

JP 08121273 A * 5/1996 ..... F02M 35/104
JP 2010-196646 A 9/2010

* cited by examiner

INTAKE MANIFOLD

BACKGROUND

The present discloser relates to an intake manifold.

The intake manifold disclosed in Japanese Laid-Open Patent Publication No. 2010-196646 is arranged between the first cylinder head of the first bank and the second cylinder head of the second bank in a V-type internal combustion engine. The intake manifold includes an upstream part and a downstream part. The upstream part is located upstream in the flow direction of intake air. The downstream part is located downstream from the upstream part in the flow direction of intake air and coupled to the upstream part. The upstream part has three upstream passages. Each of the upstream passages has a downstream section divided into two subsections by a partition wall. The downstream part has six downstream passages corresponding to the six subsections of the upstream passages.

As the engine operates and thermally expands, the first cylinder head and the second cylinder head of the engine deform away from each other. This causes corresponding stress on the downstream part of the intake manifold. Particularly, a central section between the first bank and the second bank in the downstream part tends to receive, in a concentrated manner, the force transmitted from the first cylinder head and the force transmitted from the second cylinder and thus may be damaged.

SUMMARY

In accordance with one aspect of the present disclosure, an intake manifold is provided that is arranged between a first cylinder head of a first bank and a second cylinder head of a second bank in a V-type internal combustion engine and configured to supply intake air from an exterior to an intake port of the first cylinder head and an intake port of the second cylinder head. The intake manifold includes a first downstream part, a second downstream part, and an upstream part. The first downstream part is configured to be coupled to the first cylinder head and has a first downstream passage configured to communicate with the intake port of the first cylinder head. The second downstream part is configured to be coupled to the second cylinder head and has a second downstream passage configured to communicate with the intake port of the second cylinder head. The upstream part is arranged upstream from the first and second downstream parts in a flow direction of the intake air and coupled to the first and second downstream parts. The upstream part has a first upstream passage that communicates with the first downstream passage and a second upstream passage that communicates with the second downstream passage. A material of the first downstream part and a material of the second downstream part both have a higher rigidity than a material of the upstream part.

Other aspects and advantages of the present disclosure will become apparent from the following description, taken in conjunction with the accompanying drawings, illustrating exemplary embodiments.

BRIEF DESCRIPTION OF THE DRAWINGS

The disclosure may be understood by reference to the following description together with the accompanying drawings.

DETAILED DESCRIPTION

Hereinafter, an intake manifold 30 according to one embodiment will be described. First, the configuration of an internal combustion engine 10, on which the intake manifold 30 is mounted, will be described.

Figure 1:
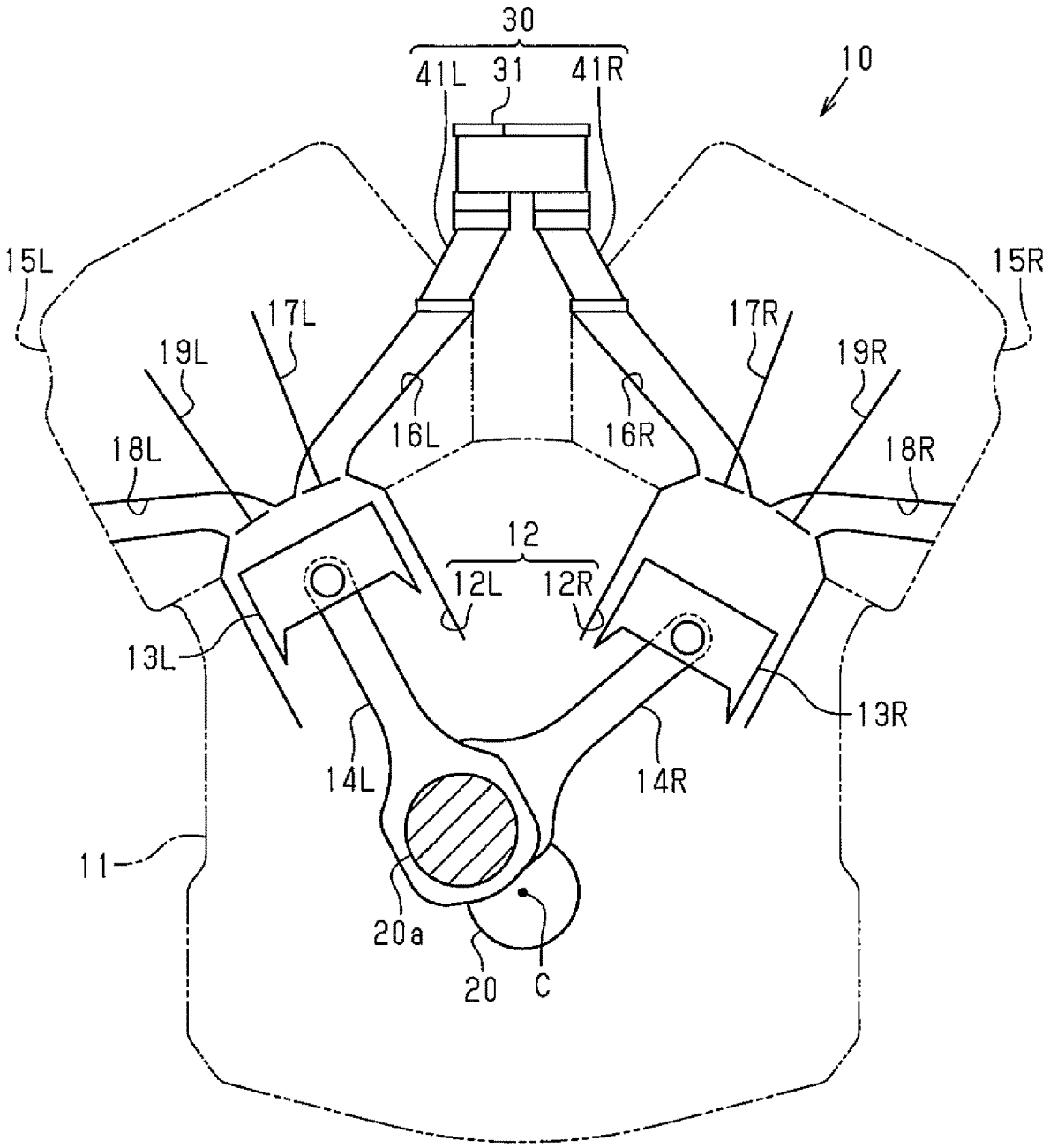
FIG. 1 is a schematic diagram representing the configuration of an internal combustion engine.

As shown in FIG. 1, a cylinder block 11 of the internal combustion engine 10 includes six cylinders 12 (only two are shown in FIG. 1). Three of the six cylinders 12 are first-bank cylinders 12L, which are aligned in a first bank. The first bank is located on one side of a rotational axis C of a crankshaft 20 (on the left side as viewed in the drawing). The remaining three of the cylinders 12 are second-bank cylinders 12R, which are aligned in a second bank. The second bank is located on the opposite side of the rotational axis C of the crankshaft 20 to the first bank (on the right side as viewed in the drawing). The first-bank cylinders 12L and the second-bank cylinders 12R are inclined toward the crankshaft 20 to become closer to each other. That is, the engine 10 is a six-cylinder internal combustion engine with a V-type cylinder arrangement.

A piston 13L is arranged in each of the first-bank cylinders 12L in a reciprocally movable manner. The piston 13L is coupled to a corresponding crank pin 20*a* of the crankshaft 20 through a piston rod 14L. Similarly, a piston 13R is arranged in each of the second-bank cylinders 12R in a reciprocally movable manner. The piston 13R is coupled to a corresponding crank pin 20*a* of the crankshaft 20 through a piston rod 14R. As the pistons 13L of the first bank and the pistons 13R of the second bank reciprocate, the crankshaft 20 rotates about the rotational axis C.

A first cylinder head 15L is attached to an upper section of the cylinder block 11 to face the first-bank cylinders 12L. The first cylinder head 15L includes three intake ports 16L to supply intake air into the three first-bank cylinders 12L. Each of the intake ports 16L corresponds to one of the first-bank cylinders 12L. Each intake port 16L has an opening that opens toward the corresponding first-bank cylinder 12L. The first cylinder head 15L includes three intake valves 17L to selectively open and close the openings of the three intake ports 16L independently from one another.

The first cylinder head 15L includes three exhaust ports 18L for discharging exhaust gas from the three first-bank cylinders 12L. Each of the exhaust ports 18L corresponds to one of the first-bank cylinders 12L. Each exhaust port 18L has an opening that opens toward the corresponding first-bank cylinder 12L. The first cylinder head 15L includes three exhaust valves 19L to selectively open and close the openings of the three exhaust ports 18L independently from one another.

A second cylinder head 15R is attached to the upper section of the cylinder block 11 to face the second-bank cylinders 12R. The second cylinder head 15R includes three intake ports 16R for supplying intake air into the three second-bank cylinders 12R. Each of the intake ports 16R corresponds to one of the second-bank cylinders 12R. Each intake port 16R has an opening that opens toward the corresponding second-bank cylinder 12R. The second cylinder head 15R includes three intake valves 17R to selectively open and close the openings of the three intake ports 16R independently from one another.

The second cylinder head 15R includes three exhaust ports 18R for discharging exhaust gas from the three second-bank cylinders 12R. Each of the exhaust ports 18R corresponds to one of the second-bank cylinders 12R. Each exhaust port 18R has an opening that opens toward the corresponding second-bank cylinder 12R. The second cylinder head 15R includes three exhaust valves 19R to selectively open and close the openings of the three exhaust ports 18R independently from one another.

The engine 10 includes an intake manifold 30 between the first cylinder head 15L and the second cylinder head 15R. The intake manifold 30 is configured to introduce intake air (atmospheric air) from the exterior of the vehicle into the intake ports 16L of the first cylinder head 15L and the intake ports 16R of the second cylinder head 15R.

The intake manifold 30 will hereafter be described further specifically.

Figure 2:
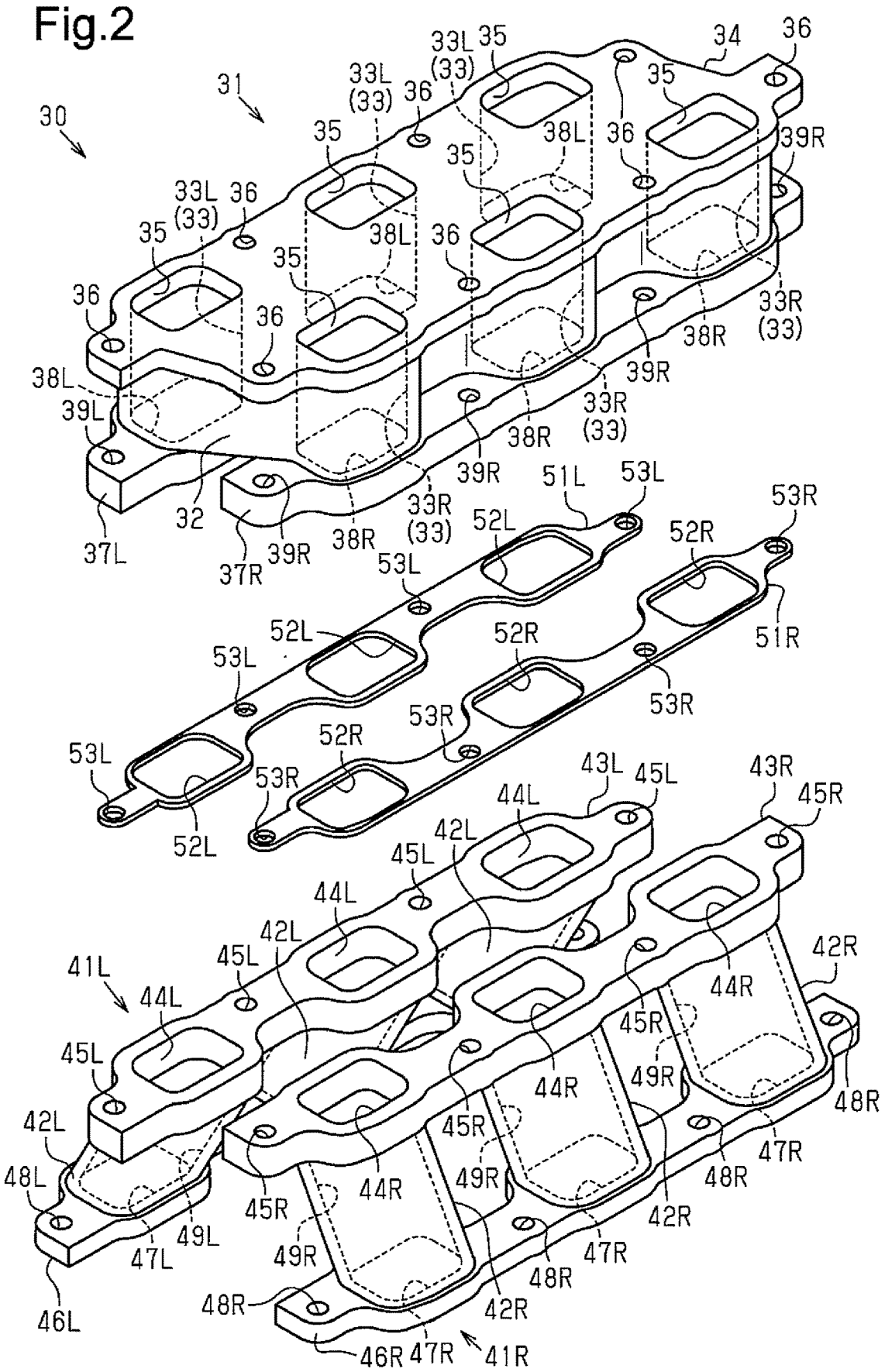
FIG. 2 is an exploded perspective view showing an intake manifold according to one embodiment.

As shown in FIGS. 1 and 2, the intake manifold 30 includes an upstream part 31, a first downstream part 41L, and a second downstream part 41R. The upstream part 31 is located upstream in the flow direction of intake air. The first downstream part 41L and the second downstream part 41R are coupled to the upstream part 31. The first and second downstream parts 41L, 41R are arranged downstream from the upstream part 31 in the flow direction of intake air and coupled to the downstream end of the upstream part 31. Hereinafter, as shown in FIGS. 1 and 2, the side on which the upstream part 31 is located will be referred to as the upper side and the side on which the first downstream part 41L and the second downstream part 41R are located will be referred to as the lower side.

As shown in FIG. 2, the upstream part 31 is an upstream passage member and includes a flat block-shaped body portion 32. The body portion 32 has six upstream passages 33 extending through the body portion 32 in the thickness direction. Three of the upstream passages 33 are arranged on one side in the transverse direction of the body portion 32 and correspond to first upstream passages 33L. The first upstream passages 33L are aligned in the longitudinal direction of the body portion 32. The remaining three of the upstream passages 33 are arranged on the opposite side to the first upstream passages 33L in the transverse direction of the body portion 32 and correspond to second upstream passages 33R. The second upstream passages 33R are aligned in the longitudinal direction of the body portion 32.

A substantially plate-shaped upstream flange portion 34 is connected to a first end face (the surface on the upstream side in the flow direction of intake air) of the body portion 32 in the thickness direction. The upstream flange portion 34 is arranged on the entire first end face of the body portion 32. The upstream flange portion 34 has sections extending outward from the outer peripheral surface of the body portion 32. The upstream flange portion 34 has six openings 35 extending through the upstream flange portion 34 in the thickness direction. The shape of each of the openings 35 is identical with the cross-sectional shape of the corresponding one of the upstream passages 33 of the body portion 32. The locations of the six openings 35 coincide with the locations of the upstream passages 33 in the body portion 32. That is, each upstream passage 33 of the body portion 32 opens upstream in the flow direction of intake air through the corresponding opening 35 of the upstream flange portion 34.

The upstream flange portion 34 has eight bolt holes 36 extending though the upstream flange portion 34 in the thickness direction. The bolt holes 36 are each located in a section of the upstream flange portion 34 outward from the outer peripheral surface of the body portion 32. That is, the bolt holes 36 do not communicate with the upstream passages 33. A non-illustrated bolt is inserted through each of the bolt holes 36, thus coupling the upstream part 31 (the intake manifold 30) to a more upstream intake passage, which is, for example, a surge tank, which temporarily stores intake air.

A substantially plate-shaped first downstream flange portion 37L and a substantially plate-shaped second downstream flange portion 37R are connected to a second end face (the surface on the downstream side in the flow direction of intake air) of the body portion 32 in the thickness direction. The first downstream flange portion 37L is located on one side in the transverse direction of the body portion 32 (on the upper left side as viewed in FIG. 2) and extends in the longitudinal direction of the body portion 32. The first downstream flange portion 37L has sections that extend outward from the outer peripheral surface of the body portion 32. The first downstream flange portion 37L has three openings 38L extending through the first downstream flange portion 37L in the thickness direction. The shape of each of the openings 38L is identical with the cross-sectional shape of the corresponding one of the first upstream passages 33L of the body portion 32. The locations of the openings 38L coincide with the locations of the first upstream passages 33L in the body portion 32. That is, each first upstream passage 33L of the body portion 32 opens downstream in the flow direction of intake air through the corresponding opening 38L of the first downstream flange portion 37L. The first downstream flange portion 37L has four bolt holes 39L extending through the first downstream flange portion 37L in the thickness direction. The bolt holes 39L are each located in a section of the first downstream flange portion 37L outward from the outer peripheral surface of the body portion 32.

The second downstream flange portion 37R is located on the opposite side to the first downstream flange portion 37L in the transverse direction of the body portion 32 (on the lower right side as viewed in FIG. 2) and extends in the longitudinal direction of the body portion 32. The second downstream flange portion 37R has sections that extend outward from the outer peripheral surface of the body portion 32. The second downstream flange portion 37R has three openings 38R extending through the second downstream flange portion 37R in the thickness direction. The shape of each of the openings 38R is identical with the cross-sectional shape of the corresponding one of the second upstream passages 33R of the body portion 32. The locations of the openings 38R coincide with the locations of the corresponding second upstream passages 33R in the body portion 32. That is, each second upstream passage 33R of the body portion 32 opens downstream in the flow direction of intake air through the corresponding opening 38R of the second downstream flange portion 37R. The second downstream flange portion 37R has four bolt holes 39R extending through the second downstream flange portion 37R in the thickness direction. The bolt holes 39R are each located in a section of the second downstream flange portion 37R outward from the outer peripheral surface of the body portion 32.

The first downstream part 41L is a first downstream passage member and includes three first tubular bodies 42L each shaped substantially like a rectangular tube. The internal space of each of the first tubular bodies 42L constitutes a first downstream passage 49L. The three first tubular bodies 42L are aligned in correspondence with the locations of the three first upstream passages 33L in the upstream part 31. Each of the first tubular bodies 42L is inclined outward in the transverse direction of the body portion 32 with respect to the up-down direction toward the downstream side in the flow direction of intake air.

A substantially plate-shaped first upper flange 43L is connected to the upper end faces of the three first tubular bodies 42L. The first upper flange 43L extends in a manner joining the upper ends of the first tubular bodies 42L to one another. The first upper flange 43L has three openings 44L extending through the first upper flange 43L in the thickness direction. The shape of each of the openings 44L is identical with the cross-sectional shape of the corresponding one of the first tubular bodies 42L. The locations of the three openings 44L coincide with the locations of the first tubular bodies 42L. That is, each of the first downstream passages 49L of the first downstream part 41L communicates with the corresponding one of the first upstream passages 33L of the body portion 32 through the corresponding opening 44L of the first upper flange 43L. The first upper flange 43L has four bolt holes 45L extending through the first upper flange 43L in the thickness direction. The locations of the bolt holes 45L correspond to the locations of the bolt holes 39L of the first downstream flange portion 37L in the upstream part 31. A non-illustrated bolt is inserted through each corresponding two of the bolt holes 45L, 39L, thus fixing the first downstream part 41L to the upstream part 31. That is, the first downstream part 41L is configured as a separate body from the upstream part 31 and coupled to the upstream part 31 using bolts.

A substantially plate-shaped first lower flange 46L is connected to the lower end faces of the three first tubular bodies 42L. The first lower flange 46L extends in a manner joining the lower ends of the first tubular bodies 42L to one another. The first lower flange 46L has three openings 47L extending through the first lower flange 46L in the thickness direction. The shape of each of the openings 47L is identical with the cross-sectional shape of the corresponding one of the first tubular bodies 42L. The locations of the three openings 47L coincide with the locations of the first tubular bodies 42L. That is, each of the first downstream passages 49L of the first downstream part 41L opens downstream in the flow direction of intake air through the corresponding one of the openings 47L of the first lower flange 46L. The first lower flange 46L has four bolt holes 48L extending through the first lower flange 46L in the thickness direction. A non-illustrated bolt is inserted through each of the bolt holes 48L, thus fixing the first downstream part 41L to the first cylinder head 15L.

A first gasket 51L made of metal is arranged between the first upper flange 43L of the first downstream part 41L and the first downstream flange portion 37L of the upstream part 31. The first gasket 51L has a plate-like shape and, as viewed from above, is shaped substantially identically with the upper end face of the first upper flange 43L of the first downstream part 41L. That is, the first gasket 51L has three openings 52L extending through the first gasket 51L. The shapes and locations of the openings 52L coincide with the shapes and locations of the openings 44L of the first upper flange 43L. The first gasket 51L also has four bolt holes 53L extending through the first gasket 51L in the thickness direction. The locations of the bolt holes 53L coincide with the locations of the bolt holes 45L in the first upper flange 43L. A non-illustrated bolt is inserted through each of the bolt boles 53L to fix the first downstream part 41L to the upstream part 31.

Although not illustrated, another metal gasket similar to the first gasket 51L is arranged between the first lower flange 46L of the first downstream part 41L and the first cylinder head 15L.

The second downstream part 41R is a second downstream passage member and includes three second tubular bodies 42R each shaped substantially like a rectangular tube. The internal space of each of the second tubular bodies 42R constitutes a second downstream passage 49R. The three second tubular bodies 42R are aligned in correspondence with the locations of the three second upstream passages 33R in the upstream part 31. Each of the second tubular bodies 42R is inclined outward in the transverse direction of the body portion 32 with respect to the up-down direction toward the downstream side in the flow direction of intake air.

A substantially plate-shaped second upper flange 43R is connected to the upper end faces of the three second tubular bodies 42R. The second upper flange 43R extends in a manner joining the upper ends of the second tubular bodies 42R to one another. The second upper flange 43R has three openings 44R extending through the second upper flange 43R in the thickness direction. The shape of each of the openings 44R is identical with the cross-sectional shape of the corresponding one of the second tubular bodies 42R. The locations of the three openings 44R coincide with the locations of the second tubular bodies 42R. That is, each of the second downstream passages 49R of the second downstream part 41R communicates with the corresponding one of the second upstream passages 33R of the body portion 32 through the corresponding opening 44R of the second upper flange 43R. The second upper flange 43R has four bolt holes 45R extending through the second upper flange 43R in the thickness direction. The locations of the bolt holes 45R correspond to the locations of the bolt holes 39R of the second downstream flange portion 37R in the upstream part 31. A non-illustrated bolt is inserted through each corresponding two of the bolt holes 45R, 39R, thus fixing the second downstream part 41R to the upstream part 31. That is, the second downstream part 41R is configured as a separate body from the upstream part 31 and coupled to the upstream part 31 using bolts.

A substantially plate-shaped second lower flange 46R is connected to the lower end faces of the three second tubular bodies 42R. The second lower flange 46R extends in a manner joining the lower ends of the second tubular bodies 42R to one another. The second lower flange 46R has three openings 47R extending through the second lower flange 46R in the thickness direction. The shape of each of the openings 47R is identical with the cross-sectional shape of the corresponding one of the second tubular bodies 42R. The locations of the three openings 47R coincide with the locations of the second tubular bodies 42R. That is, each of the second downstream passages 49R of the second downstream part 41R opens downstream from the second downstream part 41R in the flow direction of intake air through the corresponding one of the openings 47R of the second lower flange 46R. The second lower flange 46R has four bolt holes 48R extending through the second lower flange 46R in the thickness direction. A non-illustrated bolt is inserted through each of the bolt holes 48R, thus fixing the second downstream part 41R to the second cylinder head 15R.

A second gasket 51R made of metal is arranged between the second upper flange 43R of the second downstream part 41R and the second downstream flange portion 37R of the upstream part 31. The second gasket 51R has a plate-like shape and, as viewed from above, is shaped substantially identically with the upper end face of the second upper flange 43R of the second downstream part 41R. That is, the second gasket 51R has three openings 52R extending through the second gasket 51R in the thickness direction.

The shapes and locations of the openings 52R coincide with the shapes and locations of the corresponding openings 44R of the second upper flange 43R. The second gasket 51R also has four bolt holes 53R extending through the second gasket 51R in the thickness direction. The locations of the bolt holes 53R coincide with the locations of the corresponding bolt holes 45R of the second upper flange 43R. A non-illustrated bolt is inserted through each of the bolt boles 53R to fix the second downstream part 41R to the upstream part 31.

Although not illustrated, another metal gasket similar to the second gasket 51R is arranged between the second lower flange 46R of the second downstream part 41R and the second cylinder head 15R.

In the intake manifold 30, which has the above-described configuration, the upstream part 31 may be made of aluminum alloy. The aluminum alloy herein refers to an alloy containing aluminum as its main element, such as corrosion-resistant aluminum, duralumin, super duralumin, or extra super duralumin. The first downstream part 41L and the second downstream part 41R may both be made of cast iron. The cast iron herein refers to an alloy containing iron as its main element and having a carbon content exceeding 2.1% and a silicon content of 1% to 3%. The upstream part 31, the first downstream part 41L, and the second downstream part 41R are all formed using a casting method in which molten metal is poured into a mold.

The Young's modulus (the modulus of longitudinal elasticity) of the aluminum alloy forming the upstream part 31 may be approximately 70 GPa. In contrast, the Young's modulus of the cast iron forming the first downstream part 41L and the second downstream part 41R may be approximately 150 GPa. That is, the material of the first downstream part 41L and the second downstream part 41R may have higher rigidity (have a greater Young's modulus) than the material of the upstream part 31.

The heat conductivity of the aluminum alloy forming the upstream part 31 may be approximately 150 W/mK to 250 W/mK. In contrast, the heat conductivity of the cast iron forming the first downstream part 41L and the second downstream part 41R may be approximately 50 W/mK. That is, the material of the first downstream part 41L and the second downstream part 41R may have lower heat conductivity than the material of the upstream part 31.

Advantages of the above-described embodiment will be described together with its operation.

As the engine 10 operates and burns fuel in the cylinders 12, the temperatures in the cylinder block 11, the first cylinder head 15L, and the second cylinder head 15R rise. This thermally expands the engine 10, thus deforming the first cylinder head 15L and the second cylinder head 15R away from each other (as viewed in FIG. 1, to the left side and to the right side, respectively). On the other hand, the upstream section of the intake manifold 30 is spaced from the cylinders 12 in the cylinder block 11 and receives low-temperature intake air before combustion. As a result, the upstream part 31 of the intake manifold 30 does not have a temperature rise as high as temperature rises in the cylinder block 11, the first cylinder head 15L, and the second cylinder head 15R. Therefore, in the above-illustrated embodiment, the cylinder block 11, the first cylinder head 15L, and the second cylinder head 15R tend to expand thermally to a greater extent than the intake manifold 30. This applies a force to the downstream ends of the first downstream part 41L and the second downstream part 41R of the intake manifold 30 to pull the first and second downstream parts 41L, 41R away from each other. Further, if the engine 10 operates in a high-load state, for example, the engine 10 vibrates correspondingly. Such vibration may also apply a force to the downstream ends of the downstream parts 41L, 41R to pull the downstream parts 41L, 41R away from each other.

It is now assumed that the downstream section of the intake manifold 30 is integrally molded without being divided into first and second downstream parts 41L, 41R and is bifurcated to extend toward the first and second cylinder heads 15L, 15R. In this case, when a force is applied to the downstream ends of the two branches of the downstream section to pull the downstream ends away from each other, the force acts on the branching portions of the downstream parts in a concentrated manner. This may deform or damage the branching portions.

However, in the above-illustrated embodiment, the downstream section of the intake manifold 30 is configured by coupling the first downstream part 41L and the second downstream part 41R, both of which are separate bodies from the upstream part 31, to the upstream part 31. The downstream section of the intake manifold 30 thus lacks branching sections unlike the above-described example. Therefore, even when a force is applied to the first downstream part 41L and the second downstream part 41R to pull the first and second downstream parts 41L, 41R away from each other, the force acts on the first downstream part 41L and the second downstream part 41R in a dispersed manner. The force is thus unlikely to act on a certain section in a concentrated manner.

In a case in which the intake manifold 30 as a whole is an integrally molded body, a highly rigid material must be used to mold the whole intake manifold 30 to ensure rigidity in the downstream section of the intake manifold 30. This increases the weight of the intake manifold 30, which is disadvantageous in reducing the weight of the vehicle.

In the above-illustrated embodiment, the first downstream part 41L and the second downstream part 41R, which correspond to the downstream section of the intake manifold 30, are configured as separate bodies from the upstream part 31. Therefore, by selecting a highly rigid material for the first downstream part 41L and the second downstream part 41R, rigidity is ensured in the downstream section of the intake manifold 30. As a result, the rigidity required for the intake manifold 30 is ensured without forming the intake manifold 30 as a whole using a heavy-weight material.

If a force is applied to the first cylinder head 15L and the second cylinder head 15R to pull the cylinder heads 15L, 15R away from each other, the force is transmitted to the upstream part 31 through the first downstream part 41L and the second downstream part 41R. The force acts on the upstream part 31 in a manner pulling the first downstream flange portion 37L and the second downstream flange portion 37R away from each other. The force thus may act in a concentrated manner on the section between the first upstream passages 33L and the second upstream passages 33R of the body portion 32 in the upstream part 31. However, the upstream part 31 is not directly coupled to the first cylinder head 15L or the second cylinder head 15R. Specifically, the first downstream part 41L and the second downstream part 41R are each arranged between the upstream part 31 and the corresponding one of the first and second cylinder heads 15L, 15R. As a result, thermal expansion of the engine 10 applies smaller force to the upstream part 31 than in a case in which the upstream part 31 is coupled directly to the first cylinder head 15L and the second cylinder head 15R.

Specifically, when the engine 10 thermally expands and the first downstream part 41L and the second downstream part 41R are deformed away from each other, the intake manifold 30 is assumed to have followed the thermal expansion of the engine 10 by the amount corresponding to such deformation. Also, the first upper flange 43L of the first downstream part 41L may be displaced slightly outward from the first downstream flange portion 37L of the upstream part 31 at the joint surface between the first downstream part 41L and the upstream part 31. The intake manifold 30 is assumed to have followed the thermal expansion of the engine 10 by the amount corresponding to such displacement. That is, the deformation or displacement at the joint surface of the intake manifold 30 in response to thermal expansion of the engine 10 attenuates the force applied to the upstream part 31 of the intake manifold 30 through the thermal expansion of the engine 10. As a result, even if a force concentrates on the section between the first upstream passages 33L and the second upstream passages 33R in the body portion 32 of the upstream part 31, damage is unlikely to happen at this section.

In a certain case, for example, the engine 10 may start at a low temperature due to the atmospheric temperature in the exterior of the vehicle. In this case, to achieve efficient operation, the temperature of the engine 10 must be raised as soon as possible. In the above-illustrated embodiment, the upstream part 31 of the intake manifold 30 is made of the aluminum alloy that has high heat conductivity and improved heat radiation performance. In contrast, the first downstream part 41L and the second downstream part 41R are made of the cast iron having lower heat conductivity than that of the upstream part 31. This hampers, when the engine 10 is starting, heat transfer from the cylinder block 11, for example, to the upstream part 31 through the first downstream part 41L and the second downstream part 41R, thus restraining radiation of the heat from the upstream part 31. As a result, in the above-illustrated embodiment, rapid engine warmup is possible after the engine 10 is started.

Specifically, the first downstream part 41L and the second downstream part 41R of the intake manifold 30 are made of cast iron and thus have higher heat conductivity to a certain extent than, for example, plastic. Therefore, if the engine 10 is in a high-load state and thus at a correspondingly high temperature, the first downstream part 41L and the second downstream part 41R are also at a high temperature. The heat is thus transferred from the first downstream part 41L and the second downstream part 41R to the upstream part 31, which is made of aluminum alloy, and actively radiated from the upstream part 31. That is, while rapid engine warmup is ensured after the engine 10 is started, the heat radiation from the upstream part 31 is brought about when the engine 10 is in a high-load state. In this regard, the first downstream part 41L and the second downstream part 41R made of the cast iron and the upstream part 31 made of the aluminum alloy represent a preferable combination of heat conductivities in the first and second downstream parts 41L, 41R and the upstream part 31.

The above-illustrated embodiment may be modified as follows. The following modifications may be combined as necessary.

The engine 10 employing the intake manifold 30 does not necessarily have to have six cylinders 12. As long as the engine 10 is a V-type internal combustion engine and has first-bank cylinders 12L and second-bank cylinders 12R, the engine 10 may have four, eight, or twelve cylinders 12. If the number of cylinders 12 of the engine 10 is changed, the number of upstream passages 33 in the upstream part 31, the number of first downstream passages 49L (the number of first tubular bodies 42L) in the first downstream part 41L, and the number of second downstream passages 49R (the number of first tubular bodies 42R) in the second downstream part 41R only need to be changed correspondingly.

The first downstream part 41L and the second downstream part 41R do not necessarily have to be coupled directly to the upstream part 31. That is, as long as communication is ensured between the first downstream passages 49L of the first downstream part 41L and the corresponding first upstream passages 33L of the upstream part 31 and between the second downstream passages 49R of the second downstream part 41R and the corresponding second upstream passages 33R of the upstream part 31, another passage configuring member may be arranged between each of the first and second downstream parts 41L, 41R and the upstream part 31. Even in this configuration, the upstream part 31 is arranged upstream from the first and second downstream parts 41L, 41R in the flow direction of intake air and coupled to the first and second downstream parts 41L, 41R. That is, the upstream part 31 only needs to be arranged upstream from the first and second downstream parts 41L, 41R in the flow direction of intake air and coupled to the first and second downstream parts 41L, 41R either directly or indirectly.

The shape of the intake manifold 30 as a whole, including the outer diameter thereof, is not restricted to that of the above-illustrated embodiment. The shape of the intake manifold 30 may be changed as needed in correspondence with the arrangement of the cylinders 12 in the engine 10, the angle between the two banks, or the shape of the first cylinder head 15L or the second cylinder head 15R.

The first downstream part 41L and the second downstream part 41R may be coupled to the upstream part 31 in any manner other than fixing with bolts. For example, if the first downstream part 41L, the second downstream part 41R, and the upstream part 31 are all made of metal, these components may be coupled together through welding. Alternatively, the first downstream part 41L and the second downstream part 41R may be coupled to the upstream part 31 using adhesive (brazing). Further alternatively, if the first downstream part 41L, the second downstream part 41R, and the upstream part 31 are all made of plastic, these components may be coupled together through welding such as laser welding.

Depending on the manner in which the first downstream part 41L and the second downstream part 41R are coupled to the upstream part 31 or the materials of these components, the first gasket 51L and the second gasket 51R may be made of plastic or may be omitted.

The materials of the upstream part 31, the first downstream part 41L, and the second downstream part 41R of the intake manifold 30 may be changed as needed as long as higher rigidity is ensured in the first downstream part 41L and the second downstream part 41R than in the upstream part 31. For example, the first downstream part 41L and the second downstream part 41R may be formed of iron steel (cast steel). Alternatively, if the material of the upstream part 31 has lower rigidity than aluminum alloy, the first downstream part 41L and the second downstream part 41R may be formed of aluminum alloy.

The materials of the upstream part 31, the first downstream part 41L, and the second downstream part 41R do not necessarily have to be selected such that the heat conductivity of the materials of the first downstream part 41L and the second downstream part 41R become lower than the heat conductivity of the material of the upstream part 31. For example, the first downstream part 41L and the second downstream part 41R may be made of cast iron or aluminum alloy and the upstream part 31 may be made of plastic. In this case, the plastic may be polyamide plastic containing reinforcement material such as glass fiber, such as nylon plastic.

The first downstream part 41L and the second downstream part 41R may be made of mutually different materials. In this case, the first and second downstream parts 41L, 41R may both be made of a material that has higher rigidity than the material of the upstream part 31.

The invention claimed is:

1. An intake manifold arranged between a first cylinder head of a first bank and a second cylinder head of a second bank in a V-type internal combustion engine, the intake manifold being configured to supply intake air from outside the internal combustion engine to an intake port of the first cylinder head and to an intake port of the second cylinder head, the intake manifold comprising:

a first downstream part configured to be coupled to the first cylinder head and having a first downstream passage configured to communicate between the intake port of the first cylinder head and a first upper flange arranged upstream from the first downstream passage;

a second downstream part configured to be coupled to the second cylinder head and having a second downstream passage configured to communicate between the intake port of the second cylinder head and a second upper flange arranged upstream from the second downstream passage; and an upstream part disposed upstream from the first and second downstream parts in a flow direction of the intake air, the upstream part being coupled to both the first and second upper flanges and having a first upstream passage in communication with the first downstream passage and a second upstream passage in communication with the second downstream passage, wherein:

the first and second upper flanges are not in contact with each other, and a material of the first downstream part and a material of the second downstream part both have a higher rigidity than a material of the upstream part.

2. The intake manifold according to claim 1, wherein the material of the first downstream part and the material of the second downstream part both have a lower heat conductivity than the material of the upstream part.

3. The intake manifold according to claim 1, wherein:

the material of the first downstream part and the material of the second downstream part are cast iron, and the material of the upstream part is an aluminum alloy or plastic.

4. An intake manifold configured to be coupled to a first bank and a second bank of a V-type internal combustion engine, the intake manifold comprising:

a first downstream passage member including a downstream end and an upstream end on an opposite side to the downstream end, the downstream end of the first downstream passage being configured to be coupled to the first bank;

a second downstream passage member including a downstream end and an upstream end on an opposite side to the downstream end, the downstream end of the second downstream passage being configured to be coupled to the second bank; and an upstream passage member coupled to the upstream end of the first downstream passage member and the upstream end of the second downstream passage member, wherein:

the upstream end of the first downstream passage member and the upstream end of the second downstream passage member are not in contact with each other, the first downstream passage member, the second downstream passage member, and the upstream passage member are separate components, and a material of the first downstream passage member and a material of the second downstream passage member both have a higher rigidity than a material of the upstream passage member.

* * * * *